US006013368A

United States Patent [19]

Aneja

[11] Patent Number: 6,013,368

[45] Date of Patent: Jan. 11, 2000

[54] COMFORT BY MIXING DENIERS

[75] Inventor: Arun Pal Aneja, Greenville, N.C.

[73] Assignee: E. I. du Pont de Nemours and Company, Wilmington, Del.

[21] Appl. No.: 09/053,810

[22] Filed: Apr. 2, 1998

Related U.S. Application Data

[62] Continuation-in-part of application No. 08/662,804, Jun. 12, 1996, Pat. No. 5,736,243, which is a continuation-in-part of application No. 08/497,495, Jun. 30, 1995, Pat. No. 5,591,523, and application No. 08/642,650, May 3, 1996, Pat. No. 5,626,961, which is a continuation-in-part of application No. 08/497,499, filed as application No. PCT/US98/06153, Mar. 31, 1998, abandoned, which is a continuation-in-part of application No. 08/497,499, filed as application No. PCT/US98/06154, Mar. 31, 1998, abandoned.

[51] Int. Cl.[7] ..... D02G 3/00

[52] U.S. Cl. ..... 428/397; 428/399; 428/357

[58] Field of Search ..... 428/397, 400, 428/357, 399, 401

[56] References Cited

U.S. PATENT DOCUMENTS

| | | | |
|---|---|---|---|
| H1275 | 1/1994 | Duncan | 428/357 |
| 2,071,251 | 2/1937 | Carothers | 18/54 |
| 2,465,319 | 3/1949 | Whinfield et al. | 260/75 |
| 3,018,272 | 1/1962 | Griffing et al. | 260/75 |
| 3,335,211 | 8/1967 | Mead et al. | 264/176 |
| 3,576,773 | 4/1971 | Vaginay | 260/22 |
| 3,914,488 | 10/1975 | Gorrafa | 428/397 |
| 4,092,299 | 5/1978 | Mac Lean et al. | 260/75 |
| 4,113,704 | 9/1978 | Mac Lean et al. | 528/289 |
| 4,634,625 | 1/1987 | Franklin | 428/258 |
| 4,707,467 | 11/1987 | Clark et al. | 428/361 |
| 4,833,032 | 5/1989 | Reese | 428/364 |
| 4,945,151 | 7/1990 | Goodley et al. | 528/272 |
| 4,966,740 | 10/1990 | Reese | 264/103 |
| 5,034,174 | 7/1991 | Reese | 264/103 |
| 5,171,309 | 12/1992 | Gallagher et al. | 604/365 |
| 5,188,892 | 2/1993 | Grindstaff | 428/362 |
| 5,250,245 | 10/1993 | Collins et al. | 264/103 |
| 5,591,523 | 1/1997 | Aneja | 428/357 |
| 5,626,961 | 5/1997 | Aneja | 428/397 |
| 5,736,243 | 4/1998 | Aneja | 428/397 |
| 5,817,740 | 10/1998 | Anderson et al. | 528/295 |
| 5,837,370 | 11/1998 | Aneja | 428/359 |

FOREIGN PATENT DOCUMENTS

| | | |
|---|---|---|
| 294912 | 12/1988 | European Pat. Off. . |
| WO 92/13120 | 8/1992 | WIPO . |
| WO 97/02372 | 1/1997 | WIPO . |
| WO 97/02373 | 1/1997 | WIPO . |
| WO 97/02374 | 1/1997 | WIPO . |

OTHER PUBLICATIONS

Marshall and Thompson, Drawing Synthetic Fibers, *Nature*, 171, 38 and 39, Jan. 3, 1953.

Marshall and Thompson, The Drawing of Terylene, *J. Applied Chem.*, 4, 145 through 153, Apr. 1954.

*Primary Examiner*—Newton Edwards

[57] ABSTRACT

Comfort properties of fibers of longitudinally-grooved fibers of scalloped-oval cross-section are improved by providing such fibers as a mixture of different dpf and using a cationic-dyeable alkali metal sulfonate isophthalate salt copolyester that is also modified with a chain-brancher so that the filaments of different dpf can be drawn simultaneously.

1 Claim, 6 Drawing Sheets

COMFORT BY MIXING DENIERS

CROSS-REFERENCE TO RELATED APPLICATION

This application is a continuation-in-part of my application Ser. No. 08/662,804 (DP-6400), filed Jun. 12, 1996, and now U.S. Pat. No. 5,736,243, being itself a continuation-in-part of my earlier applications Ser. No. 08/497,495 (DP-6255), filed Jun. 30, 1995, and now U.S. Pat. No. 5,591,523 and Ser. No. 08/642,650 (DP-6365-A), filed May 3, 1996, and now U.S. Pat. No. 5,626,961, itself a continuation-in-part of my earlier application Ser. No. 08/497,499, filed Jun. 30, 1995, now abandoned, and also derives priority from PCT/US98/06153, filed Mar. 31, 1998 (DP-6635) and from PCT/US98/06154, filed Mar. 31, 1998 (DP-6295).

FIELD OF THE INVENTION

This invention concerns improving comfort by mixing deniers per filament of polyester fibers of scalloped-oval cross-section and of cationic-dyeable copolyester composition that has been modified with a chain-brancher to provide for an ability to be drawn simultaneously, and to such drawing processes and to products therefrom.

BACKGROUND OF THE INVENTION

Polyesters have been produced commercially on a large scale for processing into shaped articles such as fibers, primarily from poly(ethylene terephthalate). Synthetic polyester yarns have been known and used commercially for several decades, having been first suggested by W. H. Carothers, U.S. Pat. No. 2,071,251, and then, in U.S. Pat. No. 2,465,319, Whinfield and Dickson suggested poly (ethylene terephthalate) which is the synthetic polymer most widely manufactured and used hitherto for textile fibers and which is often referred to as homopolymer PET. Homopolymer PET has generally been preferred over copolymers because of its lower cost, and also because its properties have been entirely adequate, or even preferred, for most end-uses. It is known, however, that homopolymer PET requires special dyeing conditions (high temperature requiring super-atmospheric pressure) not required for nylon fibers, for example, so copolyesters have been suggested and used commercially for some purposes, e.g., cationic-dyeable copolyesters such as have been disclosed by Griffing and Remington in U.S. Pat. No. 3,018,272 and by Hansen et al. in U.S. Pat. Nos. 5,171,309 (DP-6335) and 5,250,245 (DP-6335-B).

Polyester fibers are either (1) continuous filaments or (2) fibers that are discontinuous, which latter are often referred to as staple fiber or cut fibers, and are made by first being formed by extrusion into continuous polyester filaments, which are processed in the form of a tow of continuous polyester filaments before being converted into staple. An important stage in the processing of continuous polyester filaments has been "drawing" to increase the orientation of the long chain polyester molecules, and thereby improve the properties of the filaments.

Mostly, the objective of synthetic fiber producers has been to replicate advantageous properties of natural fibers, the most common of which have been cotton and wool fibers. Most polyester cut fiber has been homopolyester PET of round cross-section and has been blended with cotton. Homopolymer PET is hydrophobic, whereas cotton absorbs moisture, and cotton fabrics have heretofore been preferred over fabrics of synthetic polymers by many people because they have believed that many cotton fabrics have been more comfortable to wear than most fabrics of most synthetic polymer fibers, which have mostly been of round cross-section as previously stated herein. Filaments of round cross-section are the easiest and most economical synthetic filaments to spin and dye, which is why practically all synthetic filaments have been of round cross-section, except for specialty filaments which are more expensive to make and more expensive to dye because of their increased surface area.

For several years, homopolymer PET fibers of generally scalloped-oval cross-section with grooves that run along the length of the fibers have been available commercially from E. I. du Pont de Nemours and Company and have given significant advantages over both cotton and over homopolymer PET fibers of round cross-section because of the increased comfort properties provided by this polyester fiber having (non-round) cross-section. Their longitudinal grooves have provided increased moisture-wicking advantages over fibers of round cross-section, and the fact that moisture is wicked along the fibers instead of being absorbed has been an advantage in contrast to cotton. Further advantages would, however, be desirable and obtainable according to the present invention.

Recently, U.S. Pat. Nos. 5,591,523 (DP-6255) and 5,626,961 (DP-6365-A) and copending application Ser. No. 08/662,804 (DP-6400) filed Jun. 12, 1996, and now allowed, corresponding respectively to WO 97/02372, WO 97/02373 and WO 97/02374, the disclosures of which are hereby incorporated herein by reference, have disclosed inventions relating to polyester tows that are suitable for conversion to slivers on a worsted or woollen system and downstream processing on such systems, eventually into fabrics and garments. The present invention has been made in the course of that work, and is described with particular reference to its value in drawing polyester filaments in tows. The tows that were disclosed in U.S. Pat. No. 5,591,523 consisted essentially of polyester filaments of scalloped-oval cross-section with grooves that run along the length of the filaments and were mixtures of filaments of higher denier per filament and of lower denier per filament with specified ranges and were suitable for processing on a worsted or woollen system. In addition to tows that are suitable for processing on a worsted or woollen system, it would be desirable to provide polyester fibers for processing on a cotton system, such as are processed entirely differently.

Cotton system processing is performed on cut staple polyester fiber and, of course, on cotton, which is a natural fiber of similar length to the cut fiber of polyester staple. Staple fiber is usually sold and packaged in compacted bales, as opposed to processing on a woollen or worsted system. The bales are opened and the fibers are conveyed on a pneumatic or mechanical system to a card. The card breaks up tufts of fibers, aligns them into a web of parallelized fibers which are formed into a continuous sliver as it leaves the card. The sliver may then be blended with other fibers such as cotton on a draw frame, and is passed through one or more additional draw frames to improve the blend and along end uniformity. The sliver is then spun into yarns on a spinning system, such as an open-end spinning frame, air jet spinning frame or ring spinning frame. In some cases, the sliver from the draw frame is converted into roving to further reduce the sliver weight, before being spun into yarn on a ring spinning frame to make yarn of appropriate size (count) and level of twist prior to fabric formation.

As, for example, has been disclosed in U.S. Pat. No. 5,591,523 (DP-6255), filaments (of generally scalloped-oval cross-section and) of different denier per filament (dpf) were desired, and surprise was expressed in Example 1 of that patent that it was possible to spin undrawn homopoly (ethylene terephthalate) (modified with tetraethyl orthosilicate) filaments that had been spun of significantly different denier on the same spinning machine without adjusting the natural draw ratio and then subsequently to draw an intimate mixture of these spun filaments simultaneously in the same tow at the same draw ratio to provide filaments with excellent properties that were different because of their differing dpfs (col 6, lines 15–29). The present invention expands on this surprising finding and extends it to the drawing simultaneously of bundles of mixed filaments that were not specified in that patent.

SUMMARY OF THE INVENTION

According to one aspect of the invention, there is provided a mixture of copolyester fibers of generally scalloped-oval cross-section with grooves that run along the length of the fibers, said copolyester being cationic-dyeable by reason of the presence of about 1 to about 2.5 mole % of an alkali metal salt of a 5-sulfonic isophthalic acid, and being chain-branched with about 0.05 to about 0.8 mole % of chain-brancher, and said mixture being a mixture of fibers having a higher denier per filament and of fibers having a lower denier per filament wherein said higher denier per filament is at least 1.2 times said lower denier per filament; such mole % is calculated conventionally as the molecular weight of the cationic dyeable salt unit or of the chain-brancher unit, respectively, divided by the molecular weight of the polymer repeat unit times 100, the repeat unit for 2G-T being ethylene terephthalate by way of example. Such fiber mixtures may be in the form of mixtures of staple (cut) fiber in various forms, including yarns, and fabrics and garments as well as the yarns themselves, and it will be understood that the mixtures of polyester fibers may also be present in mixtures with other fibers, such as of other synthetic polymers, including polyamides (nylons of various types) and polyolefins, for example, and/or natural fibers, such as cotton, in any of such forms.

The terms "filament" and "fiber" are used inclusively herein, and are not generally intended to be mutually exclusive; sometimes, however, these general terms are modified, as in terms such as "continuous filament" and "staple fiber".

According to another aspect of the invention, there is provided a process of drawing a mixture of copolyester fibers of generally scalloped-oval cross-section with grooves that run along the length of the fibers, said copolyester being cationic-dyeable by reason of the presence of about 1 to about 2.5 mole % of an alkali metal salt of a 5-sulfonic isophthalic acid, and being chain-branched with about 0.05 to about 0.8 mole % of chain-brancher, and said mixture being a mixture of fibers having a higher denier per filament and of fibers having a lower denier per filament, wherein said higher denier per filament is at least 1.2 times said lower denier per filament.

Preferably the higher denier is at least 1.5 times the lower denier.

Significantly, as will be explained in relation to the stress-strain curves in the Examples, no neck drawing has been experienced in contrast to experience when drawing filaments of homopolymer 2G-T.

DETAILED DESCRIPTION

Figure 1:
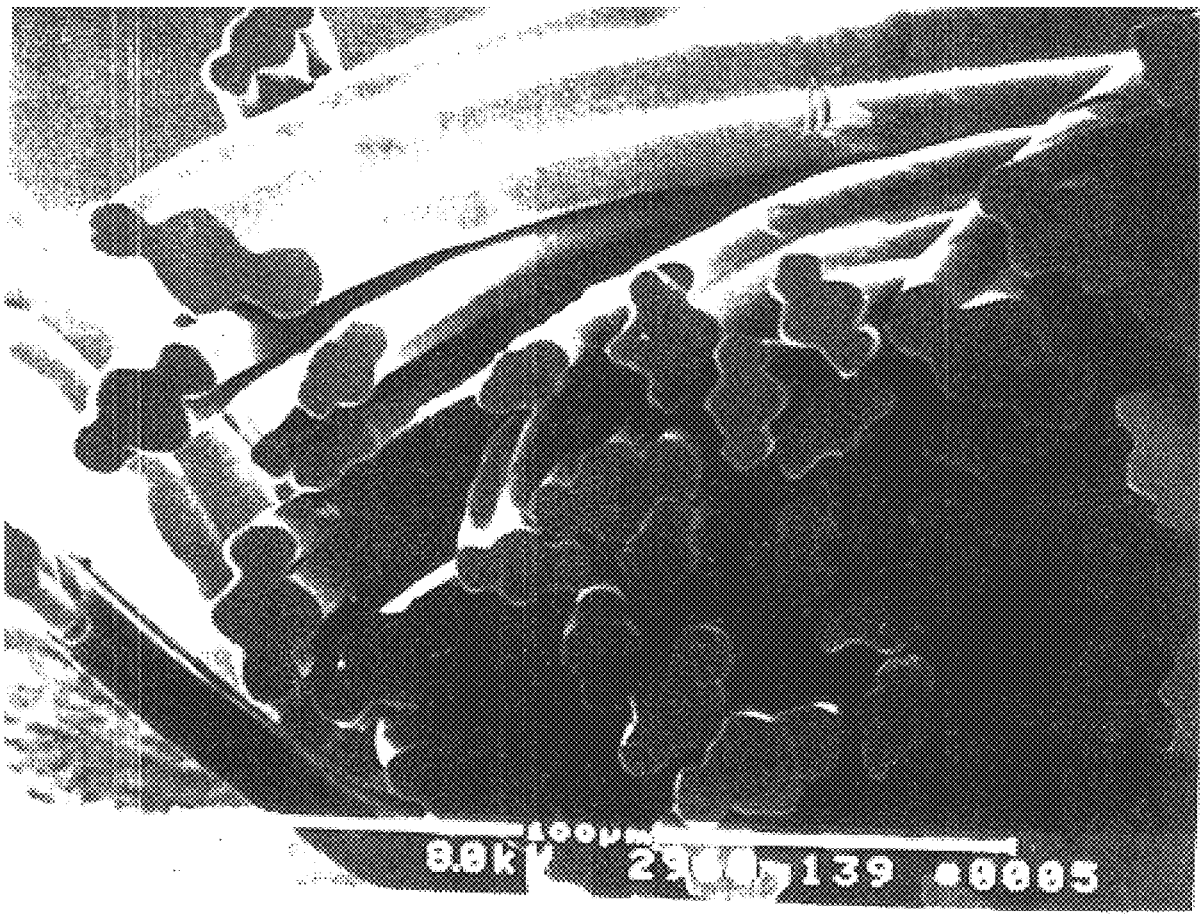
FIG. 1 is a magnified photograph of a mixture of fibers according to the invention to show their cross-sections, as explained hereinafter in greater detail.

It would be redundant to repeat what has already been disclosed in the art. As has been indicated, the preparation of polyester polymers and spinning of filaments therefrom has been disclosed generally in the art. The drawing of polyester filaments has also been disclosed in many references dating back to those by Marshall and Thompson in Nature, Vol. 171 (Jan. 3, 1953), pages 38–39, *"Drawing Synthetic Fibers"*, in J. Applied Chem., 4 (April 1954), pages 145–153 *"The Drawing of Terylene"*, and in Proc. Roy. Soc. (London), Vol. A221, pages 541–557, *"The Cold Drawing of High Polymers"*.

Mixtures of polyester fibers of generally scalloped-oval cross-section with grooves that run along the length of the fibers have already been disclosed in U.S. Pat. No. 5,591,523, such mixtures being of higher denier and of lower denier as specified therein. According to the present invention, the copolyester fibers should be a mixture of fibers having a higher denier per filament and of fibers of low denier per filament, wherein said higher denier per filament should be at least 1.2 times said lower denier per filament; denier per filament is frequently referred to as dpf hereinafter. The mixture of deniers according to the invention (sometimes referred to hereinafter as dual-denier) provides improved comfort in fabrics as described hereinafter in contrast to fabrics of single denier fiber yarns of like scalloped-oval cross-section. While the invention is not limited to any theory, I believe that my dual denier fibers allow for better water-wicking because of the greater amount of spacing between adjacent fibers which do not pack so closely together as can fibers of like cross-section but of the same dpf because the fibers of the present invention are not all of the same dpf. We have demonstrated improvements in the Examples hereinafter with varying proportions of the higher and lower dpf fibers and varying ratios of higher:lower dpf. Preferably, however, the higher:lower dpf ratio should not get too large, especially not more than about 5:1. As for the amounts of the fibers of higher and lower dpf, these may be calculated on the basis of relative numbers or relative weights of fibers. As may be seen in Example 2 hereinafter, a Light:Heavy filament Number Ratio of 2:1 (with a dpf ratio of 1:2) gave significant improvements in WVT (Water Vapor Transmission) and % Moisture in fabrics over Number Ratios of Light:Heavy filaments that were almost 4:1 and higher, so small number ratios, preferably of about 3:1 or less are generally preferred, while recognizing that other considerations, such as the dpf ratio, can also affect such results, including the twist of the yarn and fabric construction. Example 2A, however, has showed that even a Light:Heavy Number Ratio of 10.5 to 1 gave a significant improvement in WVT and % Moisture after 2 hours over the single dpf Comparison. The Examples indicate a so-called "nominal denier" for convenience, because many people are not used to thinking in terms of yarns, tows or other fiber bundles with mixtures of deniers, the "nominal denier" being the total denier of the fiber bundle divided by the total number of fibers for the filamentary tows, yarns or other bundles of fibers referred to therein. Recently, textile operators have shown increasing interest in lower dpfs than are available from natural fibers, such as cotton, including interest especially in subdenier fibers. Textile operators have generally preferred for textile fibers dpfs of less than about 3 dpf (3.3 dtex), but the invention is applicable also to mixtures of copolyester fibers of any dpf.

As for fiber cross-sections, any generally scalloped-oval cross-section is applicable. U.S. Pat. No. 5,591,523 describes mostly such cross-sections with 4 grooves that run along the length of the fibers, fiber cross-sections having 4 grooves having been disclosed by Gorrafa in U.S. Pat. No.

3,914,488 more than 20 years ago, and by others, including Franklin and by Clark et al. some 10 years later in U.S. Pat. Nos. 4,707,467 and 4,634,625, respectively. Fibers of scalloped-oval cross-sections having 6 and 8 grooves are disclosed in U.S. Pat. No. 5,626,961 and in application Ser. No. 08/778,462, filed Jan. 3, 1997 and now allowed, (Aneja DP-6365-A and Roop DP-6550), respectively, and such scalloped-oval fiber cross-sections are also contemplated as suitable according to the present invention. Mixtures of cross-sections would also be expected to provide increased comfort, especially mixtures of scalloped-oval cross-sections with differing numbers of grooves, and are contemplated according to the present invention. The aspect ratios of the scalloped-oval fiber cross-sections should generally be at least 1.3:1 to provide sufficient difference from round fibers. As the aspect ratio increases, the benefit of the scalloped-oval cross-section may diminish, so aspect ratios of up to about 3:1 are generally preferred, it being understood that this may depend on other factors, such as the number of grooves. Similarly, a generally scalloped-oval cross-section whose grooves are not located at the minor axis of the oval is generally preferred for some purposes (unlike a peanut-type of cross-section, for example). Groove ratios herein are calculated as the minimum thickness of a filament cross-section (i.e., at the bottom of the groove on opposite sides of the cross-section divided by the maximum thickness of the cross-section at an adjacent bulge of the cross-section, e.g., $d_1/b_1$ and $d_2/b_2$ as described in U.S. Pat. No. 5,626,961, referred to hereinbefore).

The only polyester fibers specifically disclosed and exemplified in U.S. Pat. Nos. 5,591,523 (Aneja DP-6255) and 5,626,961 (Aneja DP-6365-A), copending applications Ser. No. 08/662,804 (Aneja DP-6400) and Ser. No. 08/778,462 (Roop DP-6550), and WO 97/02372, 97/02373 and 97/02374, all referred to hereinabove, were of homopolymer PET modified with a chain-brancher. In contrast to such modified homopolymer PET, fibers of the present invention are of cationic-dyeable copolyester composition on account of the presence of about 1 to about 2.5 mole % of an alkali metal salt of a 5-sulfonic isophthalic acid. Cationic-dyeable copolyesters have been disclosed in the art, e.g., by Griffing and Remington in U.S. Pat. No. 3,018,272, and by Hansen et al. in U.S. Pat. Nos. 5,171,309 (DP-6335) and 5,250,245 (DP-6355-B), the disclosures of which are hereby incorporated herein by reference. Such cationic-dyeable copolyester compositions for fibers according to the present invention should also be modified with about 0.05 to about 0.8 mole % of chain-brancher to provide for an ability to draw the filamentary mixtures of differing dpfs simultaneously according to the present invention and also, if desired, to spin differing dpfs through different capillary orifices in the same spinneret as disclosed hereinafter in Example V. The amount of chain-brancher is preferably at least about 0.2 and preferably up to about 0.3 mole % according to the present invention. The use of chain-branchers (i.e., multi-functional, polyester-forming intermediates having more than the requisite two functional groups that are required for polymerization, such as a glycol and a dibasic acid, both of which are difunctional) has been disclosed in art such as MacLean et al., U.S. Pat. Nos. 4,092,299 and 4,113,704, Mead et al. in U.S. Pat. No. 3,335,211, Oxford et al. WO/92/13,120, Duncan, U.S. SIR H1275, DuPont (Broaddus et al.) EPA2 294,912, Reese, U.S. Pat. Nos. 4,833,032, 4,966,740 and 5,034,174, Goodley et al. in U.S. Pat. No. 4,945,151, and art referred to and cited therein, such as Vaginay, U.S. Pat. No. 3,576,773. Some of these references used different terminology, such as viscosity builders, because the materials were added to enhance spinning performance, or for other reasons. Much of this prior art related to high-speed spinning of continuous filament yarns as feed yarns for draw-texturing, so those continuous filaments were spin-oriented, rather than amorphous, such as has generally been preferred hitherto for drawing in tow form for conversion into cut fiber, which is of special interest and preference according to the present invention. A low shrinkage of about 0.5 to about 3% for the mixtures of filaments according to the invention distinguishes our drawn filaments from filaments of higher shrinkage made by high speed spinning to make spin-oriented filaments for use as feed yarns for draw-texturing, often referred to as POY. This shrinkage is the boil off shrinkage that is referred to at the bottom of col 6 of Knox U.S. Pat. No. 4,156,071, and may be measured in the manner described there by Knox. As indicated, U.S. Pat. No. 5,591,523 and WO 97/02372 have already disclosed in Example I the simultaneous drawing of a tow of homopoly(ethylene terephthalate) (modified with tetraethyl orthosilicate) filaments of mixed dpf and that it was surprising that this could be accomplished to give drawn filaments that were satisfactory and with no dark dye defects.

TEST PROCEDURES

Most of the test procedures that were used are well-known and/or described in the art. To avoid any doubt, explanations of procedures that were used are given in the following paragraphs.

Units. Measurements were made using conventional U.S. textile units, including denier, which is a metric unit. To meet prescriptive practices elsewhere, dtex and CPcm equivalents of the DPF and CPI measurements are given in parentheses after the actual measurements. For the tensile measurements (MOD, for initial modulus, and TEN, for tenacity), however, the actual measurements in gpd have been converted into g/dtex and these latter have been given in the Tables, whereas the stress-strain curves in the Figures show original metric tensile values on the Y-axis.

Instron. The average stress-strain curves were obtained as follows as an average of 10 individual filaments of each type taken from the tow bundle. Ten samples of each type of filament were separated from the tow bundle using a magnifying glass (LUXO Illuminated Magnifier). The denier per filament (DPF) of each sample filament was measured on a VIBROSCOPE (HP Model 201C Audio Oscillator). The sample filaments were mounted one at a time on an INSTRON (Model 1122 or 1123) and the stress-strain behavior was measured. Ten breaks were recorded for each filament type, and the average of the 10 samples was recorded for each filament type so, as will readily be understood, values read from a stress-strain curve of an individual filament do not necessarily correlate with tensile properties calculated and listed as an average in the Tables.

The dimensions for the fiber cross sections were obtained using the following procedure. A fiber specimen is mounted in a Hardy microtome (Hardy, U.S. Department of Agriculture circa 378, 1933) and divided into thin sections according to methods essentially as disclosed in "Fiber Microscopy Its Technique and Applications" by J. L. Sloves (van Nostrand Co., Inc., New York 1958, No. 180–182). Thin sections are then mounted on a super FIBERQUANT video microscope system stage (Vashaw Scientific Co., 3597 Parkway Lane, Suite 100, Norcross, Ga. 30092) and displayed on the Super FIBERQUANT CRT under magnifications as needed. The image of an individual thin section of one fiber is selected and critical fiber dimensions measured. This process is repeated for each filament in the field of view to generate a statistically significant sample set, and the averages are given herein.

The aspect and groove ratios were calculated as described in the application (DP-6585-A) filed Dec. 17, 1997, by Anderson et al.

Relative Viscosity (LRV) is the viscosity of polymer dissolved in HFIP solvent (hexafluoroisopropanol containing 100 ppm of 98% reagent-grade sulfuric acid). The viscosity-measuring apparatus is a capillary viscometer obtainable from a number of commercial vendors (Design Scientific, Cannon, etc.). The relative viscosity in centistokes is measured on a 4.75 wt % solution of polymer in HFIP solvent at 25° C. as compared with the viscosity of pure HFIP solvent at 25° C. The $H_2SO_4$ used for measuring LRV destroys cross-links, specifically silicon in the case of tetraethyl ortho silicate chain-brancher.

Non-Acid Relative Viscosity (NRV) is the viscosity of polymer similarly dissolved, measured and compared in hexafluoro-isopropanol solvent but without any sulfuric acid. Since the acid is not present, the cross-links are left intact when the NRV is measured.

Delta RV (ΔRV) is the expression we have used herein to define the difference between the NRV and the LRV measured as described above, and express the amount of cross-linking destroyed by the acid when measuring LRV.

Performance properties to measure rates of wicking, drying and water vapor transmission were measured on fabrics made as follows. Staple fiber of cut length 1.5 inches (38 mm) is converted into yarn of 30/1 cc, as of 22/1 cc, as indicated, and such yarn is knit on a 48-feed single jersey, 22-cut machine. The knit fabric is scoured for 10 minutes at 160° F. (71° C.) with an aqueous solution containing 30 grams of Merpol HCS and 30 gms of tetrasodium pyrophosphate, rinsed at room temperature for 5 minutes, dyed for 20 minutes at 220° F. (104° C.) at 15 psi (1 Kg/cm$^2$) in a 69-gallon (260 liter) Klauder, Weldon, Giles Model 25 PW beck dye machine with 3% OWF Sevron Blue GBR 200%, 4% OWF carrier (Intercarrier 9P), 5% OWF sodium sulfate and 25 ml acetic acid, rinsed until clear, dried in a home laundry-type dryer (Kenmore) for 10 minutes at about 150° F. (65° C.), and pressed with a dry iron (heated to a permanent press setting). The resulting dyed and finished fabrics were evaluated for aesthetics, "hand" and cover and also for performance properties, as follows.

Moisture Transport (Wicking Rate) is the ability of a material to move water by capillary action. Vertically-suspended specimens of knit fabric are immersed to a given depth in water. At specified time intervals, the distance that the water has traveled up the specimen is measured and reported. Four specimens of 1 inch×7 inches (2.5 cm×18 cm) with the longer dimension parallel with the wale or machine direction from a sample are conditioned at 70+/−2° F. (21° C.) and 65+/−2% relative humidity for a minimum of 16 hours. One end of the long direction of each specimen is clipped to a support rack in a vertical position so that the other (free) end is placed in a container where it becomes immersed to a depth of 1.8 inches (4.6 cm) distilled, demineralized water at 70+/−2° F. (21° F.) while simultaneously starting a stopwatch. The height that the water rises above the water level in the container is measured to the nearest 0.1 inch (0.3 cm) at 0, 5, 10 and 30 minute intervals. The average height (in inches) at each time interval (in minutes) of all of the specimens for each sample is reported.

Dry Rate is the ability of a material to evaporate water. Fabric specimens are saturated in water and weighed at specified time intervals while drying. The loss of water over time is measured and recorded. Three specimens of 4 inches×6 inches (10 cm×15 cm) are conditioned at 70+/−2° F. (21° C.) and 65+/−2% relative humidity for a minimum of 24 hours. The samples are weighed and recorded as dry weight. The specimens are submerged in a 250 ml beaker filled with regular tap water for 10 minutes with frequent stirring to remove air bubbles. The specimens are removed from the beaker and the excess water is removed by hand-squeezing and blotting between paper towels to get the wet weight to equal twice the dry weight. The specimens are then hung while a stopwatch is started. Their weight is recorded at 20 minute intervals for 120 minutes. The percent moisture is calculated as:

$$\text{Moisture (\%)}=[(\text{wet weight}-\text{dry weight})/\text{dry weight}]\times 100$$

The average moisture (%) at each time interval (in minutes) of all of the specimens for each sample is reported. Thus the "Dry Rate" is recorded at the % Moisture that is retained, a lower % Moisture indicating a faster Dry Rate, which is generally preferred.

Water Vapor Transmission is the flow of water dispersed in air (moisture) through a material which occurs when the humidity on the two sides of the material is different. Specimens are mounted in a cup over water, and the whole assembly weighed before and after 24 hours in a controlled atmosphere. The weight gain or loss is calculated as the weight change per unit area of the specimen (g/24 hours/sq m). The method used is the same as ASTM E-96 Standard Test Methods of Water Vapor Transmission of Materials with the following exceptions. A relative humidity of 55% is used instead of 50%. Only the Water Method (and not the Desiccant Method) was used.

Crimp Frequency was measured as the number of crimps per inch (CPI) after the crimping of the tow. The crimp is exhibited by numerous peaks and valleys in the fiber. Ten filaments are removed from the tow bundle at random and positioned (one at a time) in a relaxed state in clamps of a fiber-length measuring device. The clamps are manually operated and initially moved close enough together to prevent stretching of the fiber while placing it in the clamp. One end of a fiber is placed in the left clamp and the other end in the right clamp of the measuring device. The left clamp is rotated to remove any twist in the fiber. The right clamp support is moved slowly and gently to the right (extending the fiber) until all the slack has been removed from the fiber but without removing any crimp. Using a lighted magnifier, the number of peaks on top and bottom side of the fiber are counted. The right clamp support is then moved slowly and gently to the right until all the crimp has just disappeared. Care is taken not to stretch the fiber. This length of the fiber is recorded. The crimp frequency for each filament is calculated as:

$$\frac{\text{Total Number of Peaks}}{2\times\text{Length of Filament (uncrimped)}}$$

The average of the 10 measurements of all 10 fibers is recorded for the CPI (crimps per inch), the metric equivalent being CPcm.

CTU (Crimp Take-Up) was also measured on tow and is a measure of the length of the tow extended, so as to remove the crimp, divided by the unextended length (i.e., as crimped), expressed as a percentage, as described in Anderson, et al., U.S. Pat. No. 5,219,582.

Product Defects are classified herein in three categories:

1) Equivalent Fabric Defects (EFD),

2) Dark Dye Defects (DDD),

3) Splinters (SPL).

The first two defects (EFD and DDD) are fibers and clumps of fibers that dye darker than normal fibers. DDDs have a diameter less than 4× the normal (drawn) fiber diameter. EFDs have a diameter 4× the normal fiber diameter or greater. Both defects must be longer than 0.25 inch (6.35 mm). Samples are processed through a roller top type card. The sliver is dyed light blue and examined visually under a lighted magnifying glass. Fibers that dye darker than the bulk of the sample are removed, classified as EFDs or DDDs and counted. Each type of defect is reported as number of defects per 0.1 pound (0.045 Kg) sliver. Splinters are oversized fibers or clumps of fibers. To be classified as a splinter, this defect must also be longer than 0.25 inch (6.35 mm) but its total diameter must be greater than 0.0025 inch (0.0635 mm). Splinters are concentrated in the flat strip waste when a staple sample is processed through a flat card. The flat strip waste is visually examined against a black background. Splinters are removed, classified by size, counted, and expressed on a weight of sample basis. More details are given in U.S. Pat. No. 5,591,523.

The invention is further illustrated in the following Examples; all parts, percentages and proportions are by weight unless indicated otherwise, polymer recipes by weight being calculated with regard to the weight of the polymer.

EXAMPLE 1

Figure 2:
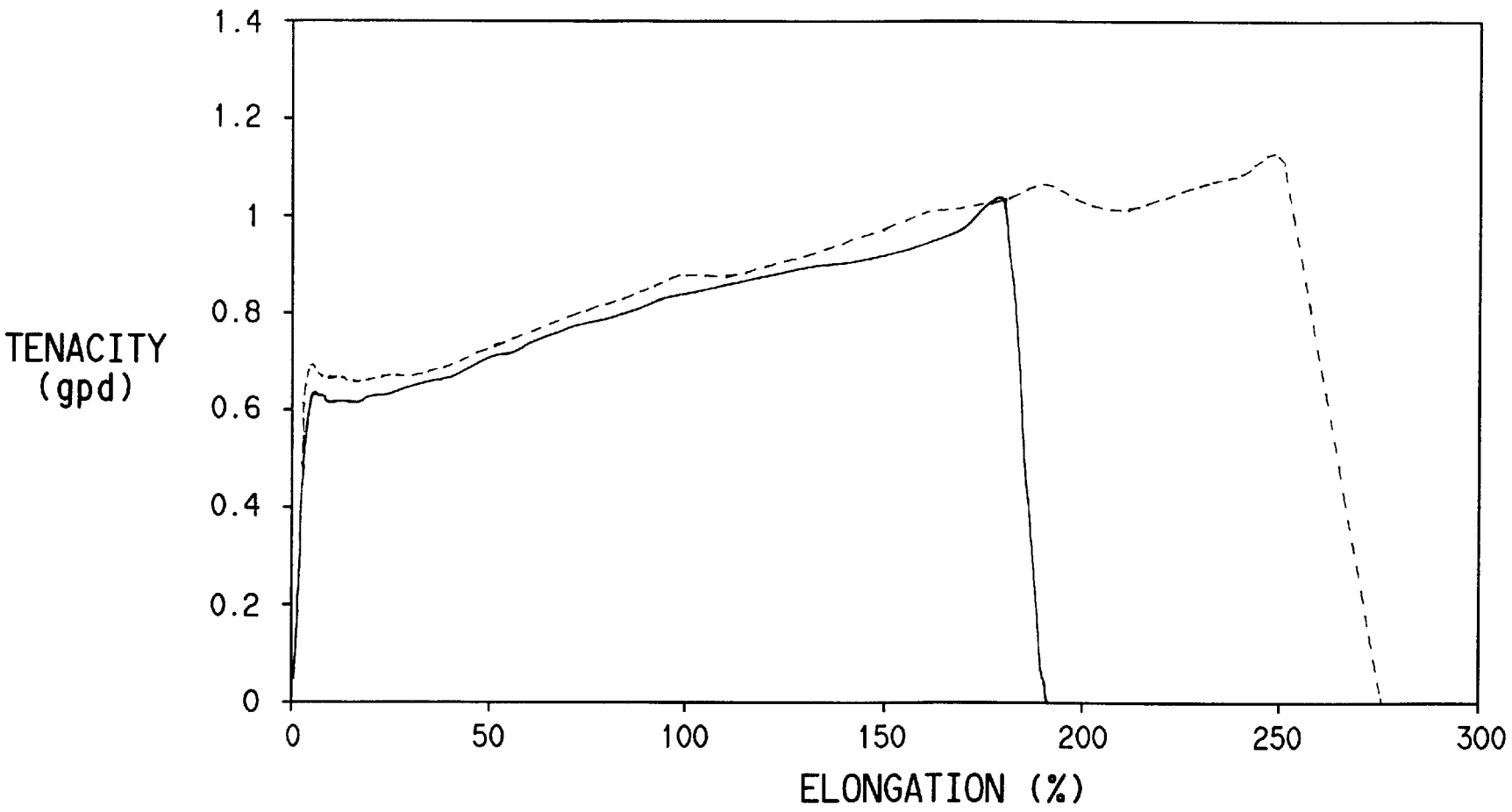
FIGS. 2 and 5 are stress-strain curves of single filaments, as described more specifically in Examples I and III hereinafter.

Higher denier (heavy) filaments of copolyester were made of ethylene terephthalate copolymerized with 2.08 mole % of sodium dimethyl 5-sulfoisophthalate and 0.20 weight % of tetraethyl orthosilicate, and containing 0.3 weight % of titanium dioxide and having relative viscosities of 10.5 LRV and 12.9 NRV so 2.4 ΔRV. Filaments of approximately 4.6 dpf (5.1 dtex) were melt-spun at 274° C. from this copolyester by being extruded at a rate of 41.6 lbs/hr (18.9 Kg) and wound on bobbins. The capillary orifice shape was three diamonds joined together as described in application Ser. No. 08/662,804 (DP-6400) filed June 12, 1996, by Aneja and as shown in FIG. 2 thereof so as to make filaments of 4-grooved scalloped-oval cross section similar to that described therein. The filaments were spun from a spinneret containing 450 such capillaries at a withdrawal speed of 1500 ypm (about 1370 meters/min), and quenched as described by Anderson, et al., in U.S. Pat. No. 5,219,582 to provide a bundle of 450 filaments of total denier 2070 (2300 dtex).

Lower denier (light) filaments of the same copolyester and of similar 4-grooved scalloped-oval cross section, but of approximately 2.6 dpf (2.9 dtex) were melt-spun similarly but were extruded at a rate of 79.3 lbs/hr (36 Kg/hr), and were spun from a spinneret containing 1506 capillaries to provide 1506 filaments of total bobbin denier about 3,910 (4350 dtex).

The as-spun properties for both types of filaments are given in Table 1A and stress/strain curves are shown in FIG. 2, the dotted line being for light filaments and the continuous line for heavy filaments.

TABLE 1A

| FIBER | DPF (dtex) | MOD | TEN | $E_B$ % | ASPECT RATIO | GROOVE RATIO |
|---|---|---|---|---|---|---|
| Light | 2.6 (2.9) | 20 | 0.96 | 164 | 1.48:1 | 0.73:1 |
| Heavy | 4.6 (5.1) | 19 | 0.84 | 134 | 1.66:1 | 0.67:1 |

Twenty bobbins of lower denier filaments (78,312 denier (87,013 dtex) (30,120 number of light filaments) and 22 bobbins of higher denier filaments (45,540 denier (50,600 dtex), 9900 number of heavy filaments) to form a nominal blend ratio of 60% light/40% heavy by denier and 75% light/25% heavy fibers by number of filaments were combined on a creel to form a tow of mixed dpf for simultaneous draw. The tow was drawn at a draw ratio of 2.7× in 85° C. spray draw of water. The tow was then passed through a stuffer box crimper and subsequently relaxed at 123° C. to give a tow of approximately 50,000 denier (55,555 dtex) of an intimate blend of nominal denier about 1.4 dpf (1.6 dtex) but containing three times as many light fibers as heavy fibers, but a 60/40 amount by weight of light (approx. 1 dpf and 1.1 dtex) and about 40% of heavy (approx. 2 dpf and 2.2 dtex) filaments with a finish level of 0.20% OWF, and the product was scrutinized for product defects. The drawn fiber properties are given in Table IB.

TABLE IB

| FIBER | DPF (dtex) | MOD | TEN | $E_B$ % | CPI (CPCM) | CTU % |
|---|---|---|---|---|---|---|
| Light | 1.0 (1.1) | 29 | 2.4 | 21 | 12.9 (5.1) | 23 |
| Heavy | 2.0 (2.2) | 35 | 2.3 | 26 | 12.4 (4.9) | 32 |

| FIBER | DHS | EFD | DDD | SPL | ASPECT RATIO | GROOVE RATIO |
|---|---|---|---|---|---|---|
| Light | 3.6 | 0 | 0 | 0 | 1.69:1 | 0.65:1 |
| Heavy | 3.2 | 0 | 0 | 0 | 1.69:1 | 0.72:1 |

Product Quality defect levels were all zero defects, so it is clear that the product quality was not adversely impacted by simultaneously drawing a mixture of different denier as-spun copolyester fibers. In addition, throughput of the draw machine was not reduced by broken filaments or roll wraps.

The tows were cut to a staple length of 1.5 inches (38 mm) and the mixed denier staple was converted to yarn (30/1 cc) and knit as described to a fabric that was dyed and finished so its comfort/performance and other characteristics could be evaluated and compared with a similar fabric made from the product of Comparison A as described hereinafter.

COMPARISON A

In contrast, filaments of similar cross-section and of approximately 3.2 dpf (3.6 dtex) were melt-spun similarly from this same copolyester by being extruded at a rate of 92.4 lbs/hr (41.9 Kg/hr), from a 14-position spin machine but otherwise essentially as described for the heavy denier filaments of Example 1 to give a tow of total denier approximately 67,500 (75,000 dtex).

The tow was drawn, crimped and relaxed essentially as for Example 1, but at a draw ratio of 2.6× to give a drawn tow of approximately 29,500 denier (32,800 dtex) of filaments all of similar 1.4 dpf (1.6 dtex). The properties of both as-spun and drawn filaments are given in Table IC.

TABLE IC

| FIBER | DPF (dtex) | MOD | TEN | $E_B$ % | CPI (CPCM) | CTU % | DHS % | ASPECT RATIO | GROOVE RATIO |
|---|---|---|---|---|---|---|---|---|---|
| Spun | 3.2 (3.6) | 8.2 | 0.87 | 219 | | | | 1.54:1 | 0.67:1 |
| Drawn | 1.4 (1.6) | 28 | 1.8 | 20 | 12 (4.7) | 26 | 27 | 1.50:1 | 0.85:1 |

This tow of single denier filaments was also cut to staple, converted to yarn that was knit to a knit fabric that was dyed and finished.

Both fabrics had the following nominal properties: weight about 5.53 oz/yd$^2$ (187 g/m$^2$) and wales×courses per inch about 29×35 (about 11×14 per cm).

Figure 3:
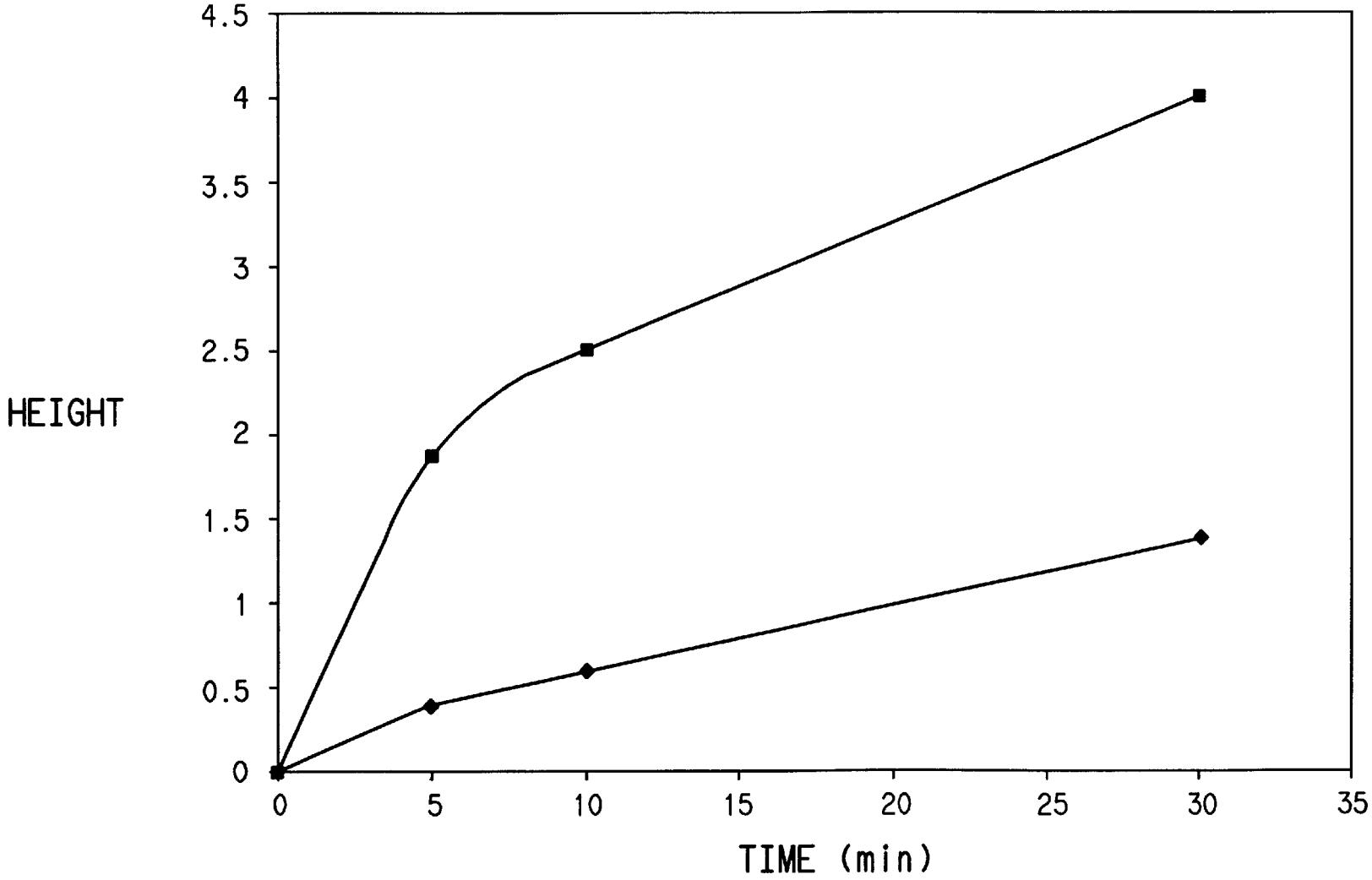
FIGS. 3, 4 and 6 provide data to show the improvement in Moisture Transports (Wicking Rates) and Dry Rates for fabrics of mixtures according to the invention in contrast to fabrics of yarns of single denier fiber, as explained in more detail in the Examples hereinafter.

Moisture Transport (Wicking Rate) properties were measured on the fabrics and are compared in FIG. 3, where the values for dual-denier fiber fabrics of Example 1 are plotted as squares, in contrast to values for single denier fiber, Comparison A, which are plotted as diamonds and the heights are plotted vs. time (in minutes). FIG. 3 shows an advantage of the fabric from Example 1 in its improved comfort as reflected by its higher Moisture Transport values, i.e., the fabric of the mixed denier product of the invention showed greatly superior Moisture Transport values in contrast to the fabric of the single denier filament product of the Comparison A.

Figure 4:
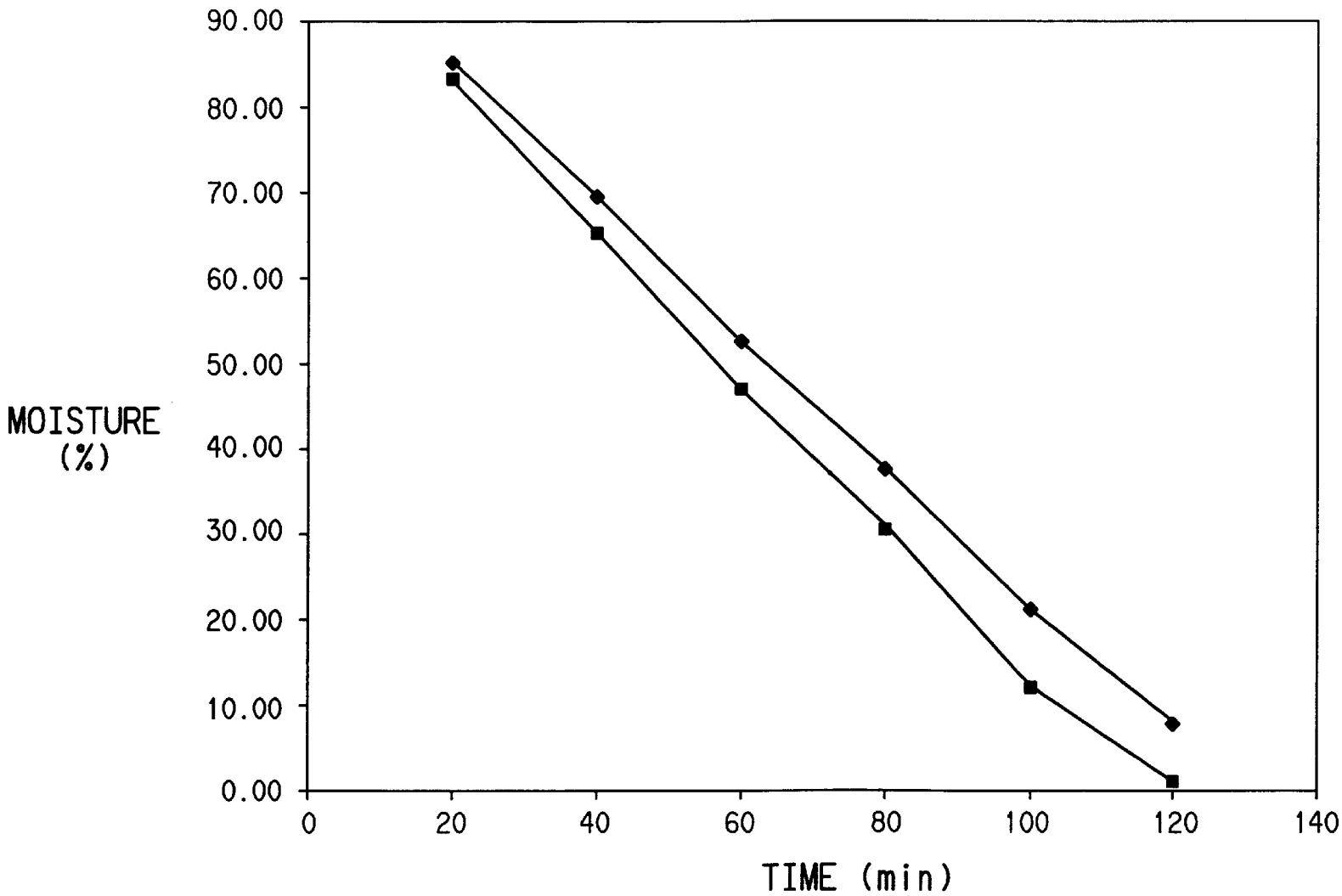

The Fabric Dry rates were measured and are compared on a similar basis in FIG. 4. FIG. 4 confirms the superior comfort provided by the fabric from Example 1, as reflected by an increased Dry Rate for the fabric of the mixed denier product of the invention in contrast to the fabric of the single denier filament product of the Comparison A.

The fabric from Example 1 also showed superior Water Vapor Transmission (3630 gm/24 hrs/m$^2$) in contrast to that of the Comparison A fabric (1583 gm/24 hrs/m$^2$).

EXAMPLE 2

Table II summarizes Water Vapor Transmission (WVT) values and % Moisture values for fibers prepared essentially as described for Example 1 (same polymer compositions and deniers) but wherein the Number Ratio (Light/Heavy filaments) was varied by adjusting the numbers of bobbins of higher or lower dpf filaments used in the draw creel. Thus for 2:1 light:heavy (Item D), there were twice as many 1 dpf fibers (light) as 2 dpf fibers (heavy).

TABLE II

| ITEM | NUMBER RATIO | EFF. DPF | WVT | % MOISTURE 20 MIN | 40 MIN | 60 MIN | 80 MIN | 100 MIN | 120 MIN |
|---|---|---|---|---|---|---|---|---|---|
| A | 10.5 to 1 | 1.23 | 2074 | 84 | 67 | 51 | 34 | 18 | 5 |
| B | 8.2 to 1 | 1.25 | 2403 | 84 | 67 | 51 | 34 | 18 | 4 |
| C | 3.9 to 1 | 1.32 | 2149 | 83 | 67 | 50 | 33 | 16 | 3 |
| D | 2.0 to 1 | 1.42 | 3688 | 76 | 59 | 42 | 25 | 9 | 0.4 |
| Comp | Single dpf | 1.4 | 1583 | 85 | 69 | 52 | 38 | 21 | 8 |

All the fabrics of dual-denier fibers showed improvements in these measurements over the Single-denier Comparison, Item D showing the greatest improvement.

EXAMPLE 3

Figure 5:
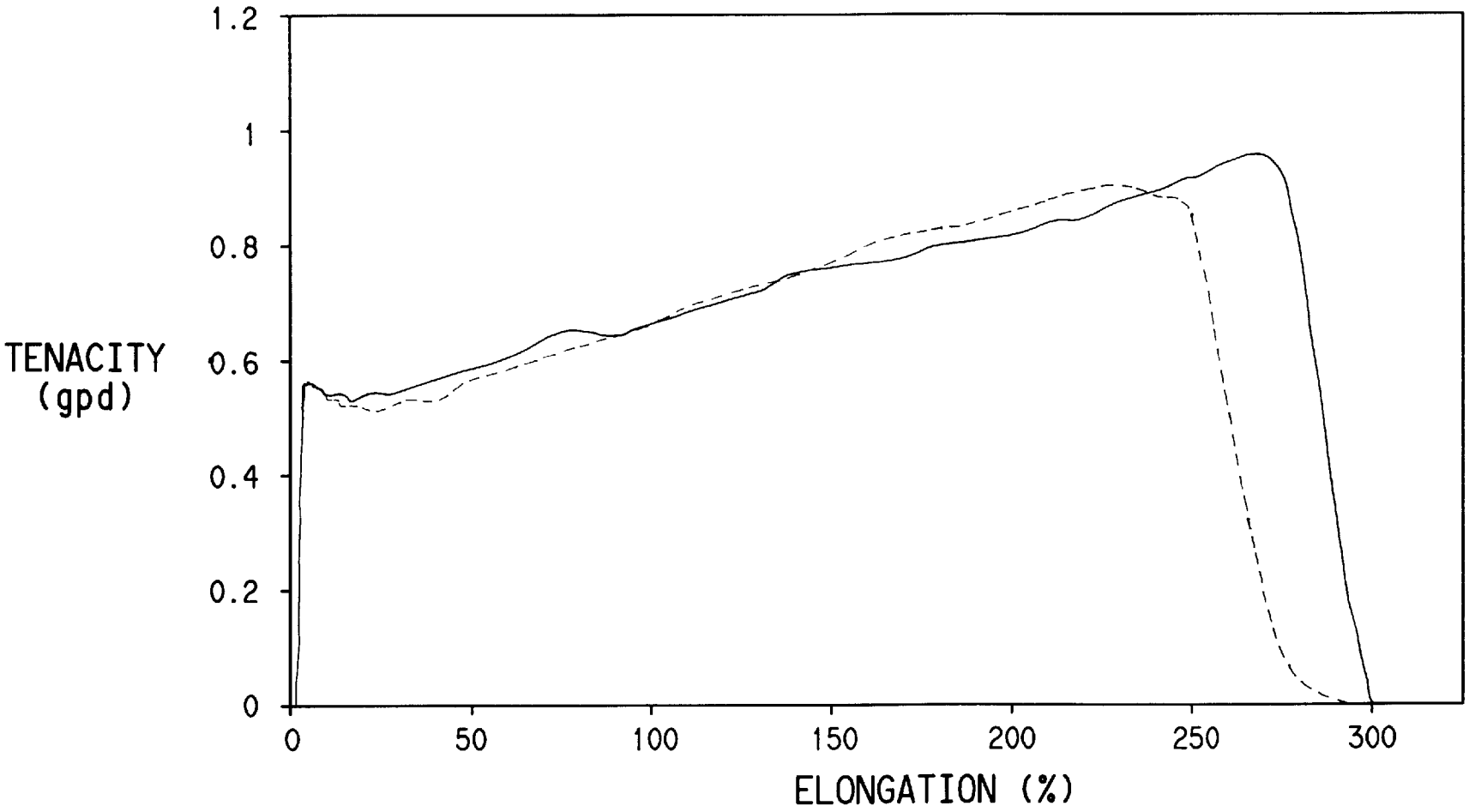

Filaments of differing deniers were spun simultaneously from different positions on the same spinning machine essentially as described in Example 1, except as follows. The copolyester was made with 2.0 mole % of sodium dimethyl 5-sulfoisophthalate and had relative viscosities of 10.2 LRV and 12.4 NRV (2.2 ΔRV). It was melt-spun at 272° C. It was extruded at a rate of 80 lbs/hr per position from 15 positions in all. Nine positions (5 positions on one side of the machine and 4 positions on the other) spun lower denier filaments (through 1506 capillaries at each position. Six positions (3 positions on each side) spun higher denier filaments through 711 capillaries at each position. All the filaments were spun at a withdrawal speed of 1600 ypm and were collected in a can as a tow that was a mixture of light and heavy denier filaments of total denier approximately 56,068 (62,300). The properties of the filaments as-spun are given in Table IIIA, while the stress-strain curves are shown in FIG. 5, as in FIG. 2.

TABLE IIIA

| FIBER | NUMBER % | DPF (dtex) | MOD | TEN | $E_B$ % | ASPECT RATIO | GROOVE RATIO |
|---|---|---|---|---|---|---|---|
| Light | 76 | 2.5 (2.8) | 10.5 | 0.8 | 197 | 1.63:1 | 0.75:1 |
| Heavy | 24 | 5.2 (5.8) | 7.9 | 0.8 | 227 | 1.45:1 | 0.62:1 |

Twenty-six cans of spun supply were combined together amounting to 463,320 filaments of total denier of approximately 1.5 million (1.7 million dtex) and were drawn, crimped and relaxed essentially as for Example 1 to give a final tow size of approximately 650,000 denier (720,000 dtex) containing light and heavy denier filaments, of nominal effective denier 1.4 (1.6 dtex), and with a finish level on the fiber of 0.25% by weight. The drawn properties are given in Table IIIB.

TABLE IIIB

| FIBER | NUMBER % | DPF (dtex) | MOD | TEN | $E_B$ % | CPI (CPCM) | CTU | ASPECT RATIO | GROOVE RATIO |
|---|---|---|---|---|---|---|---|---|---|
| Light | 76 | 1.08 (1.2) | 40 | 2.5 | 17 | 12.2 (4.8) | 25 | 1.46:1 | 0.66:1 |
| Heavy | 24 | 2.29 (2.54) | 34 | 2.3 | 19 | 12.2 (4.8) | 25 | 1.65:1 | 0.88:1 |

Eff dpf = 1.4

The product was scrutinized for product quality defect level of EFD, DDD, and SPL, all of which registered zero defects, so it is clear that the product quality was not adversely impacted by simultaneously drawing a mixture of different denier as-spun copolyester fibers. In addition, throughput of the draw machine was not reduced by broken filaments or roll wraps.

The tow was also cut to staple, converted to yarn of 22/1 cc that was knit to a fabric that was dyed and finished, otherwise as for Example 1, and so its comfort/performance and other fabric characteristics could be evaluated as described. The surprising feature was the improved performance properties of water vapor permeability and dying rate of fabric obtained from mixed denier fibers versus fabrics made from essentially single denier, as will be related now.

COMPARISON B

In contrast, filaments of similar cross-section and of approximately 3.4 dpf (3.8 dtex) were made from copolyester that was similar, except that 0.15 weight % of tetraethyl orthosilicate was used to make polymer having relative viscosities of 10.3 LRV and 12.9 NRV, so 2.6 ΔRV filaments by being extruded at a rate of 92.4 lbs/hr (41.9 Kg/hr) from a 13-position spin machine, each position having a spinneret containing 1506 capillaries, at a withdrawal speed of 1500 ypm. The total denier of the tow using 28 cans for the creel was approximately 1.9 million (2.1 million dtex). The tow was drawn at a draw ratio of 2.5×, but otherwise drawn, crimped and relaxed essentially as described for Example 1 to give a drawn tow of approximately 767,000 denier (852,000 dtex) of filaments of 1.4 dpf (1.6 dtex). The spun and drawn filament properties are given in Table IIIC.

TABLE IIIC

| FIBER | DPF (dtex) | MOD | TEN | $E_B$ % | CPI (CPCM) | CTU % | DHS % | ASPECT RATIO | GROOVE RATIO |
|---|---|---|---|---|---|---|---|---|---|
| Spun | 3.4 (3.8) | 10 | 0.9 | 212 | | | | 1.42:1 | 0.85:1 |
| Drawn | 1.4 (1.6) | 28 | 1.6 | 22 | 12 (4.7) | 29 | 2.7 | 1.45:1 | 0.83:1 |

Figure 6:
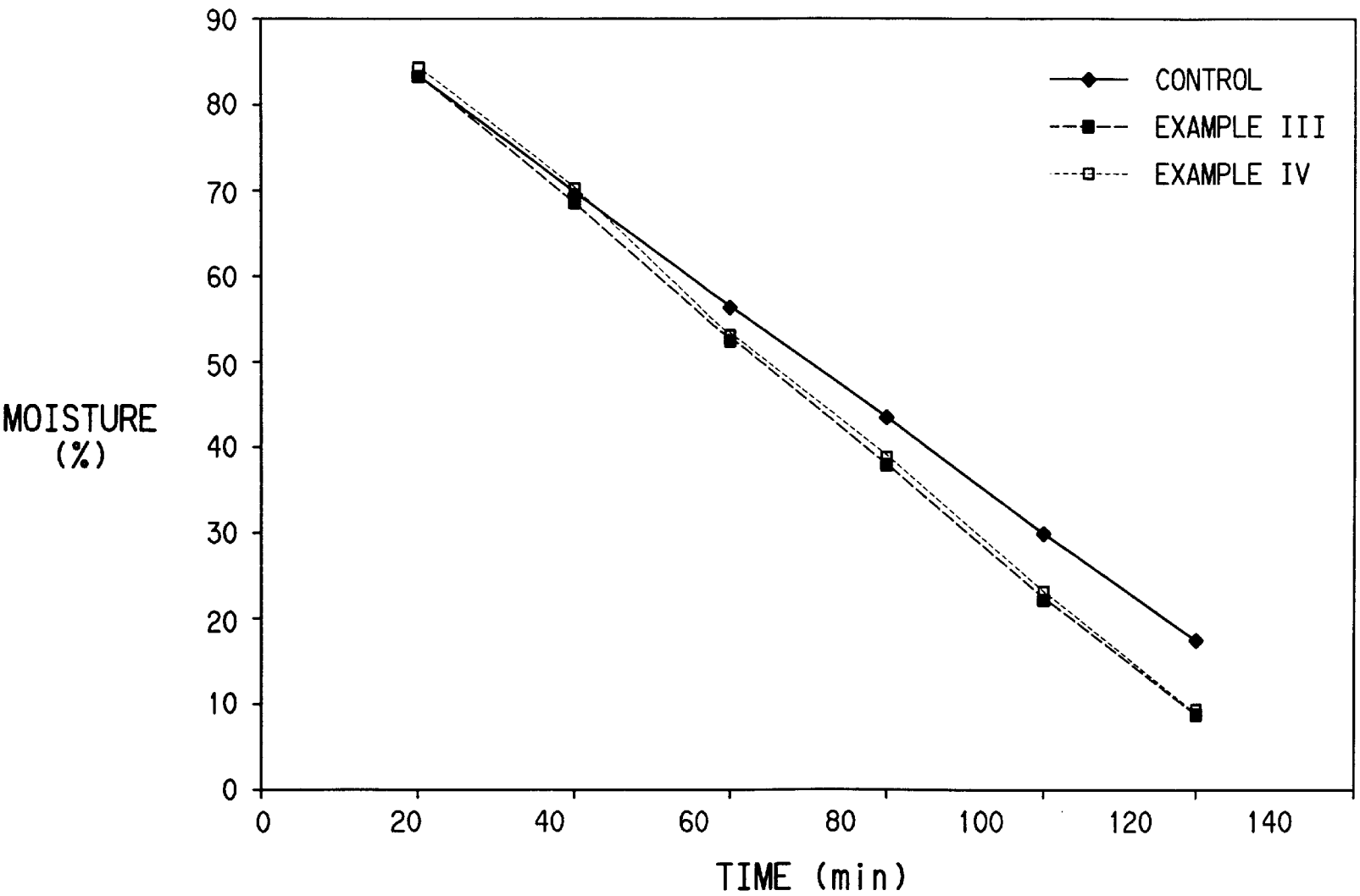

The drawn tows from each of Example III and of Comparison B were cut to staple and converted to yarns of 22/1 cc, that were knit to fabrics that were dyed and finished, essentially as described. Both fabrics had the following nominal properties: weight about 6.60 oz/yd$^2$ (324 g/m$^2$) and wales×courses per inch about 26×32 (about 10×13 per cm). The Dry Rate properties were measured on the fabrics and are compared in FIG. 6 where the values for dual-denier fiber fabrics of Example III are plotted as solid squares, in contrast to values for single denier fiber, Comparison B, which are plotted as diamonds (as well as values for Example IV hereinafter), the moisture content remaining in the fabric (in percent) being plotted versus time (in minutes). An advantage of the invention is the superior comfort as reflected by the faster Dry Rate for fabrics of mixed denier products of the invention which showed a significant improvement over the fabric of Comparison B. The fabric obtained from the dual-denier yarn also showed superior WVT (1797 g/24 hrs/$m^2$) versus the single denier Comparison B (1232 g/24 hrs/$m^2$).

EXAMPLE IV

In Table IV, data are summarized for fibers spun essentially as described for Example III, but wherein the Number % and denier were different. The Number % of light and heavy fibers in a blend can be adjusted by varying the number of capillaries and positions on the spin machine to make more or less heavy or light filaments. For this 85/15 (light/heavy) blend, I used 11 positions of 1506 capillaries per end for light filaments and 4 positions with 711 capillaries per end for heavy filaments at a throughput of about 80 lbs/hr/end (36 Kg) at a withdrawal speed of 1800 ypm (1650 mpm). The tows were drawn at 2.3× draw ratio and otherwise processed essentially as described for Example III into staple, yarn and knit fabric. The fabric obtained from this dual-denier yarn showed superior moisture vapor permeability (1464 g/24 hrs/$m^2$) versus the single denier Comparison B (1232 g/24 hrs/$m^2$) and superior Dry Rate, shown as open squares in FIG. 6, which correlate with superior comfort as reflected by these properties.

TABLE IVA

| | | SPUN FIBER PROPERTIES | | | | | |
|---|---|---|---|---|---|---|---|
| FIBER | NUMBER % | DPF (dtex) | MOD | TEN | $E_B$ % | ASPECT RATIO | GROOVE RATIO |
| Light | 85 | 2.54 (2.8) | 12 | 0.9 | 188 | 1.49:1 | 0.87:1 |
| Heavy | 15 | 5.76 (6.4) | 8 | 0.8 | 225 | 1.50:1 | 0.82:1 |

| BLEND | | DRAWN FIBER PROPERTIES | | | | | | | |
|---|---|---|---|---|---|---|---|---|---|
| FIBER | COMP % (BY NUMBER) | DPF | MOD | TEN | $E_B$ % | CPI (CPCM) | CTU | ASPECT RATIO | GROOVE RATIO |
| Light | 85 | 0.967 (1.07) | 39 | 2.1 | 17 | 11 (4.3) | 26 | 1.51:1 | 0.87:1 |
| Heavy | 15 | 2.03 (2.26) | 34 | 2.2 | 19 | 11 (4.3) | 26 | 1.58:1 | 0.70:1 |

I found it surprising that it was possible to make yarns from two different fibers of different deniers of this copolyester (ethylene terephthalate copolymer made with sodium dimethyl 5-sulfoisophthalate and modified with tetraethyl orthosilicate) that had been spun of significantly different denier on the same spinning machine, and then draw them together (in a single tow) to provide filaments of differing dpfs and that the eventually-resulting fabrics (and garments) had superior comfort properties that were better than those of fabrics and garments made similarly from filaments that were all of the same denier as shown in the foregoing Examples and Comparisons.

EXAMPLE V

Mixed filaments were melt-spun at 272° C. from the same copolyester as used in Example III, such mixed filaments being a 50/50 mixture of light/heavy filaments, both of scalloped-oval cross-section, and both melt-spun simultaneously through different capillaries in the same spinneret, each containing 1000 capillaries, at a total rate of 23.68 lbs/hr (10.75 Kg) and wound on bobbins at 1800 ypm (1650 mpm). The spinnerets had 516 capillaries, each of flow area 0.0003079 sq in (0.1986 sq mm) to make heavy filaments and 484 capillaries each of flow area 0.0002224 sq in (0.1435 sq mm) to make light filaments. The smaller capillaries were located on the inner five (of 9) rings while the larger capillaries were located on the outer four rings of the spinneret. The orifice shape for the capillaries was as used in the foregoing Examples, as were the remaining spinning conditions. Properties of the resulting spun filaments are given in Table VA.

TABLE VA

| FIBER | NUMBER % | DPF (dtex) | MOD | TEN | $E_B$ % | ASPECT RATIO | GROOVE RATIO |
|---|---|---|---|---|---|---|---|
| Light | 48 | 1.13 (1.26) | 12 | 0.9 | 185 | 1.69:1 | 0.65:1 |
| Heavy | 52 | 2.54 (2.8) | 12 | 1.0 | 189 | 1.48:1 | 0.73:1 |

Sixty-eight bobbins of the as-spun mixed filaments were combined to form a tow of denier approximately 126,000 (140,000 dtex). The tow was drawn, crimped and relaxed essentially as described for Example IV to give an intimate blend of crimped light and heavy denier filaments with a finish level (on fiber) of 0.20%, their properties being given in Table VB, and their nominal denier per filament (i.e., the denier of the total tow bundle divided by the number of filaments) being 1.15 dpf.

TABLE VB

| FIBER | DPF (dtex) | MOD | TEN | $E_B$ % | CPI (CPCM) | CTU % | ASPECT RATIO | GROOVE RATIO |
|---|---|---|---|---|---|---|---|---|
| Light | 0.9 (1.0) | 41 | 2.1 | 17 | 15 (5.9) | 19 | 1.50:1 | 0.63:1 |
| Heavy | 1.39 (1.54) | 39 | 2.1 | 17 | 11 (4.3) | 15 | 1.50:1 | 0.85:1 |

The product was processed and then scrutinized for product defects, EFD, DDD, and SPL, all of which registered as zero defects, so it is clear that the product quality of this copolyester of ethylene terephthalate copolymer containing tetraethyl silicate was not adversely impacted by simultaneously drawing a mixture of different denier as-spun filaments, which was surprising and contrary to previous experience in attempts to process filaments of mixed denier made essentially similarly from homopolymer without chain-brancher.

What is claimed is:

1. A mixture of copolyester fibers of generally scalloped-oval cross-section with grooves that run along the length of the fibers, said copolyester being cationic-dyeable by reason of the presence of about 1 to about 2.5 mole % of an alkali metal salt of a 5-sulfonic isophthalic acid, and being chain-branched with about 0.05 to about 0.8 mole % of chain-brancher, and said mixture being a mixture of fibers having a higher denier per filament and of fibers having a lower denier per filament, wherein said higher denier per filament is at least 1.2 times said lower denier per filament.

* * * * *